United States Patent [19]

Shibano

[11] Patent Number: 4,865,060

[45] Date of Patent: Sep. 12, 1989

[54] ULTRASONIC CLEANING SYSTEM

[75] Inventor: Yoshihide Shibano, Aikoh, Japan

[73] Assignee: S & C Co., Ltd., Aikoh, Japan

[21] Appl. No.: 301,152

[22] Filed: Jan. 25, 1989

[51] Int. Cl.[4] ..... B08B 3/10

[52] U.S. Cl. ..... 134/60; 134/108; 134/184; 134/186

[58] Field of Search ..... 134/60, 108, 109, 105, 134/184, 96, 186; 68/355

[56] References Cited

U.S. PATENT DOCUMENTS

| | | | |
|---|---|---|---|
| 2,541,471 | 7/1950 | Calhoun | 68/355 |
| 3,085,948 | 4/1963 | Kearney | 134/108 X |
| 3,292,576 | 12/1966 | Linderman | 134/105 X |
| 3,308,839 | 3/1967 | Barday | 134/108 X |
| 3,632,480 | 1/1972 | Surprenant | 134/105 X |
| 3,873,071 | 3/1975 | Tatebe | 134/184 X |
| 4,014,751 | 3/1977 | McCord | 134/108 X |
| 4,333,485 | 6/1982 | Carlsson et al. | 134/184 X |
| 4,409,999 | 8/1988 | Miller | 134/184 X |

*Primary Examiner*—Frankie L. Stinson

*Attorney, Agent, or Firm*—Cushman, Darby & Cushman

[57] ABSTRACT

Disclosed is an improvement of ultrasonic cleaning system equipped with degassing means or boiling vessel to remove gases from cleaning liquid for activating the formation of cavitation in the cleaning bath. The ultrasonic cleaning system is improved according to the present invention in that the boiling vessel is used to supply the degassed liquid to the cleaning vessel to form a high-temperature zone on the cleaning bath, and that a circulation conduit is provided to supply the cleaning liquid from the high-temperature zone to the bottom of the cleaning vessel. The improved structure permits the creation of a high-temperature zone and a low-temperature or cleaning zone in one cleaning vessel, thereby preventing the dissolution of surrounding gases into the cleaning liquid, and at the same time, subjecting objects to ultrasonic-cleaning at a controlled temperature which is appropriate for ultrasonic cleaning, thereby improving the cleaning effect, and hence the cleaning efficiency.

3 Claims, 1 Drawing Sheet

ULTRASONIC CLEANING SYSTEM

BACKGROUND OF THE INVENTION

1. Field of the Invention

Figure 1:
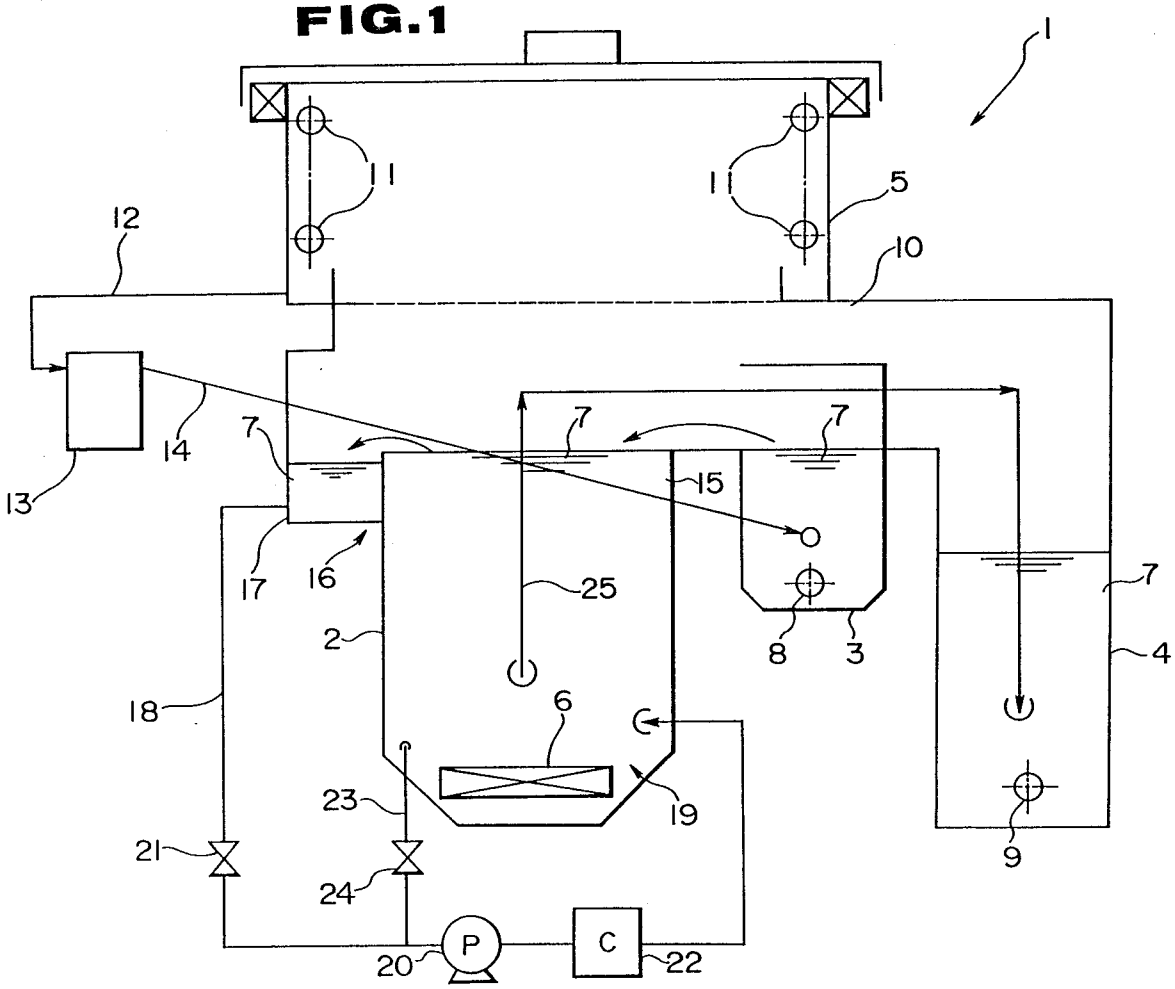

The present invention relates to an ultrasonic cleaning system equipped with degassing means, and more particularly to such an ultrasonic cleaning system which permits circulation of cleaning liquid through the system, still allowing its cleaning vessel to have two distinct zones, one being kept at such an appropriate temperature as has an effect on the degassing of the cleaning liquid, the other being kept at such an appropriate temperature as has an effect on the cleaning of an object to be put in the cleaning vessel.

2. Description of the Prior Art

The applicant field a patent application, claiming a patent to an ultrasonic cleaning apparatus equipped with degassing means. In the ultrasonic cleaning apparatus proposed therein, the cleaning liquid is subjected to degassing process in an attempt to enhance cavitation in the cleaning bath. At the time of radiation of ultrasonic waves into the cleaning bath there will be caused drastic decrease of pressure in selected places in certain conditions, and then the liquid pressure is decreased below saturated vapor pressure so that bubbles will appear in the bath. These vapor pockets will enlarge and then collapse to generate extraordinary high pressure. Such cavitation can be enhanced by degassing the cleaning liquid.

The applicant found that the proposed ultrasonic cleaning apparatus has a good cleaning effect per unit time. Specifically, it requires shotened cleaning time to remove dirt or filth from an object, compared with an ultrasonic cleaning apparatus equipped with no degassing means. The proposed ultrasonic apparatus has a boiling vessel as degassing means downstream of the cleaning vessel, and a vapor vessel downstream of the boiling vessel. Also, the proposed ultrasonic apparatus has a collection vessel upstream of the cleaning vessel, and a vapor-condenser and a water-separator upstream of the boiling vessel.

In operation, cleaning liquid which contains gas is continuously supplied from the vapor vessel to the boiling vessel after passing through the vapor-condenser tubes and the water-separator. The boiling vessel will deprive the cleaning liquid of impurities whose boiling points are than the boiling point of the cleaning liquid, and then, the cleaning liquid which contains possible least solute components will return to the cleaning vessel. Continuous repetion of this process will assure that the cleaning vessel is filled with the cleaning liquid which is degassed to its limit.

Then, the oscillator is used to generate and radiate ultrasonic waves into the cleaning bath to cause the cleaning bath to decrease in pressure until it reaches the saturated vapor pressure at the liquid temperature, and then the liquid bath will have eruptions to cause cavities to appear in the bath. Thus, the cavitation will be most likely to be caused. The study of the proposed ultasonic cleaning apparatus revealed that it would be ideal if the cleaning bath has a relatively thigh-temperature zone in its upper part and a relatively low-temperature zone in its lower part, and that the relatively low-temperature zone has an increased cleaning effect. This was not realized in designing the proposed ultrasonic cleaning apparatus.

SUMMARY OF THE INVENTION

With the above in mind one object of the present invention is to provide an ultrasonic cleaning system which can improve the degassing effect on the cleaning liquid. The cleaning liquid which is deprived of its gas contents by the boiling bessel, will be supplied to the cleaning vessel to form a cleaning liquid membrane at its boiling temperature which is laid, on the cleaning bath all the time; thereby preventing the dissolution of surrounding gases into the underlying cleaning bath. Another object of the present invention is to provide an ultrasonic cleaning system which has an improved cleaning effect. Its cleaning vessel is designed to have a relatively low-temperature zone as a cleaning zone. The cleaning liquid in this cleaning zone is forcedly circulated to assure that the cleaning zone is kept at a relatively low-temperature. This forced circulation of the cleaning liquid has an effect to remove oil and fat contents from the cleaning liquid. and this will increase the cleaning effect still more.

To attain these objects an ultrasonic cleaning system comprising; a cleaning vessel which is filled with a cleaning liquid and is designed to soak objects to be cleaned in its cleaning bath; an ultrasonic vibrator for radiating ultrasonic waves into the cleaning bath; an oscillator associated with said ultrasonic vibrator; and degassing means to remove gases from said cleaning liquid for activating the formation of cavitation in said cleaning bath at the time of radiating ultrasonic waves into said cleaning bath, said degassing means comprising a boiling vessel positioned on the side on which said cleaning liquid is supplied to said cleaning vessel, thereby removing from said cleaning liquid the gases whose boiling point is lower than the boiling point of said cleaning liquid, is improved according to the present invention in that the degassed cleaning liquid is supplied to said cleaning vessel to provide a high-temperature zone at the top level of said cleaning bath; and that said ultrasonic cleaning system further comprises: a collection vessel to collect the cleaning liquid when it overflows from said high-temperature zone of said cleaning bath, said collection vessel being connected by a circulation conduit to a low-temperature zone of said cleaning bath at the bottom level of said cleaning bath, thereby permitting the cleaning liquid to return to said cleaning vessel; a vapor vessel and a collection conduit to supply the cleaning liquid from said cleaning vessel to said vapor vessel, extending from an object-soaking position at an intermediate level between said high-temperature zone and said low-temperature zone in said cleaning bath.

According to a preferred embodiment of the present invention said circulation conduit may have a filter, a pump and a coling unit, said pump having an adjustment valve on its primary side The cleaning system according to a preferred embodiment of the present invention may comprise a temperature controlling conduit between said pump and said adjustment valve, said temperature controlling conduit being equipped with a temperature control valve and being connected to said cleaning vessel at a level which is lower than the level at which said circulation conduit is connected to said cleaning vessel.

Other objects and advantages of the present invention will be understood from the following description of an ultrasonic cleaning system according to one embodiment of the present invention which is shown in a sole accompanying FIG. 1.

Referring to FIG. 1 there is diagrammatically shown the structure of the ultrasonic cleaning system. The ultrasonic cleaning system 1 mainly comprises a cleaning vessel 2, a boiling vessel 3, a vapor vessel 4, and a vapor condenser 5. The cleaning vessel 2 is a sole vessel equipped with an ultrasonic vibrator of piezoelectric type, which is connected to an oscillator (not shown). The cleaning vessel is filled with a cleaning liquid 7, and is designed to soak objects to be cleaned in its cleaning bath. The boiling vessel 3 is positioned on the side on which the cleaning liquid is supplied to the cleaning vessel 2. The boiling vessel 3 has a heating pipe 8 for heating the cleaning liquid 7 around its boiling temperature, thereby removing from the cleaning liquid 7 the gases whose boiling point is lower than the boiling point of the cleaning liquid to supply the degassed cleaning liquid to the cleaning vessel 2. Among many different cleaning liquids Flon 113 is selected and used in this particular embodiment. Its boiling temperature is 47.6° C. Therefore, the heater in the boiling vessel 3 will be heated around 47° C. to remove from the cleaning liquid the dissolved gases whose boiling points are lower than the boiling point of Flon 113.

The vapor vessel 4 is positioned adjacent to the boiling vessel 3, downstream of the cleaning vessel 2 as seen in the direction in which the cleaning liquid is supplied. The vapor vessel 4 is equipped with a heater 9 for heating the cleaning liquid 7 above its boiling point. The piping 11 is arranged above the top space 10 of the cleaning vessel 2 and the boiling vessel 3 to constitute the vapor condenser 5.

When the rising vapor reaches the condenser 5, it will be condensed to liquid, which will be supplied to a water separator 13 via a conduit 12. There, the water if carried by objects which were put in the cleaning vessel, will be removed from the cleaning liquid. Then, the dewatered cleaning liquid 8 is supplied to the boiling vessel 3 via a conduit 14. The cleaning liquid 7 will be boiled and deprived via a conduit 14. The cleaning liquid 7 will be boiled and deprived of its impurities by fractional distillation using different boiling points. Only the cleaning liquid 7 will be supplied to the cleaning vessel 2 to form a high-temperatire zone of boiling point, which is laid on the cleaning bath at the top level 15 of the cleaning vessel 2.

The resulting high-temperature zone has an effect to prevent the invasion of other gases from the surrounding atomosphere into the cleaning bath. Accordingly, the cleaning bath will be kept free from dissolved gases, and accordingly the cleaning effect will be improved.

A collection vessel 17 is connected to the front of the cleaning vessel 2 to collect overflowing cleaning liquid as large in volume as objects which are thrown in the cleaning vessel 2. The collection vessel 17 is connected by a circulation conduit 18 to the bottom level 19 of the cleaning bath 2, thereby permitting the overflowing cleaning liquid to return to the cleaning vessel 2. The circulation conduit 18 has a circulation pump 20. The pump 20 has an adjustment valve 21 on its primary side and a filter (not shown) and a cooling unit 22 on its secondary side.

A low-temperature zone results at the bottom level 19 of the cleaning bath 2 in contrast to the top 15 of the cleaning vessel 2. A temperature controlling conduit 23 branches from the circulation conduit 18 between the circulation pump 20 and the adjustment valve 21. This temperature controlling conduit 23 is equipped with a temperature control valve 24, and is connected to the cleaning vessel at a level which is lower than the level at which the circulation conduit 18 is connected to the cleaning vessel 2.

The cleaning liquid 7 is supplied from the intermediate cleaning zone between the top high-temperature zone and the bottom low-temperature zone of the cleaning vessel 2 to the vapor vessel 4 via a collection conduit 25, and then the cleaning liquid 7 is heated above its boiling point by an associated heater 9, thereby changing the cleaning liquid to vapor.

In the course of circulation of the cleaning liquid 7 via the circulation conduit 18 by the pump 20. impurities or foreign substances such as oil will be removed from the cleaning liquid by a filter, and at the same time, the cleaning liquid whose temperature is raised by ultrasonic radiation, will be deprived of its heat by the cooling unit 22, thereby keeping the cleaning liquid at a predetermined low temperature.

In the particular embodiment Flon 113 is used as a cleaning liquid. Flon 112, iso-propylalcohol, trichloroethylene, perchloroethylene, 1,1,1-trichloroethane or their azeotropic substances or water may be equally used as a cleaning liquid.

This particular embodiment uses a single cleaning vessel 2, but as a matter of course a plurality of cleaning vessels may be used.

Now, the operation of the ultrasonic cleaning system is described below.

First, an object to be cleaned is put in the cleaning vessel 2, and then the ultrasonic vibrator 6 is put in operation. The cleaning liquid overflows from the cleaning vessel 2 to enter the collection vessel 17. The cleaning liquid is supplied to the bottom 19 of the cleaning vessel 2 via the circulation conduit 18.

The cleaning liquid 7 is supplied from the intermediate cleaning zone to the vapor vessel 4 via the collection conduit 25. The cleaning liquid 7 is heated in the vapor vessel 4 by the heater 9 to change the cleaning liquid to vapor. When the rising vapor comes to contact with the condenser pipe 11, it will be reduced to liquid.

The resulting cleaning liquid will enter the water separator 13 via the conduit 12 to remove the water content from the cleaning liquid. The dewatered cleaning liquid 7 enters the boiling vessel 3 via the comduit 14. It will be heated by the heater 8, and then the impurities whose boiling points are lower than that of the cleaning liquid will be removed by fractional distillation. Thus, the degassed cleaning liquid will be supplied to the cleaning vessel 2.

The degassed cleaning liquid 7 at its boiling temperature is supplied to the top part 15 of the cleaning vessel 2 to form a high-temperature zone on the cleaning bath. The overlying high-temperature zone will prevent surrounding gasses whose boiling point is below that of the cleaning liquid from dissolving into the underlying bath. Thus, it has a degassing effect on the cleaning liquid in the cleaning vessel 2.

The cleaning liquid as large in volume as the object thrown in the cleaning vessel 2, will overflow from the high-temperature zone of the cleaning vessel 2 to the collection vessel 17, and then the overflowing liquid will be cooled and supplied to the bottom 19 of the cleaning vessel 2 to cool the intermediate cleaning zone, thereby improving the cleaning effect on the object in the cleaning vessel 2. The cooling unit 22 in the circulation conduit 18 will keep the cleaning liquid at a predetermined low temperature.

The temperature controlling conduit 23 brancing from the circulation conduit 18, is connected to the cleaning vessel 2 at a selected level which is lower than the level at which the circulation conduit 18 is connected to the cleaning vessel 2. This connection of the temperature controlling conduit 23 at a lower level makes it easy to control the temperature of the cleaning liquid so as to be appropriate for ultrasonic-cleaning. In case that oil or fat is removed from the object to precipitate on the bottom of the cleaning vessel 2, these foreign substances can be carried away and removed by using the temperature controlling conduit 23 and the pump 20 to circulate the cleaning liquid through an appropriate filter.

The collection conduit 25 extends from the intermediate cleaning zone between the high- and low-temperature zones in the cleaning vessel 2 to the vapor vessel 4 to supply the cleaning liquid 7, which is heated as a result of ultrasonic vibration and contains foreign substances. Such cleaning liquid will be heated in the vapor vessel for distillation.

As is apparent from the above, the structure of the ultrasonic cleaning system permits the creation of a high-temperature zone and a low-temperature or cleaning zone in one and same cleaning vessel, thereby preventing the dissolution of surrounding gasses into the cleaning liquid, and at the same time, subjecting objects to ultrasonic cleaning at a controlled temperature which is appropriate for ultrasonic cleaning, thereby improving the cleaning effect, and hence the cleaning efficiency. Also, in the course of the circulation by the pump 20 of the cleaning liquid 7 via the circulation conduit 18, foreign substances if any, will be removed from the cleaning liquid 7 by filter and the like The cooling unit 22 will deprive the cleaning liquid of the heat gained from the ultrasonic vibration, thereby keeping the cleaning liquid at a controlled temperature which is appropriate for increasing cavitation, and hence, ultrasonic-cleaning effect.

The ultrasonic cleaning system described above uses a sole cleaning vessel. As a matter of course a plurality of cleaning vessels can be used. The compactness in structure permits reduction of the whole size, requiring a reduced space to occupy.

Oil and other foreign substance which are removed from the objects while cleaning, are likely to precipitate towards the bottom of the cleaning vessel. The impurity-free cleaning liquid, however, is tranferred from the high-temperature zone at the top level to the bottom of the cleaning vessel via the circulation conduit so that the impurity content of the cleaning liquid in the low-temperature zone is reduced accordingly.

I claim:

1. Ultrasonic cleaning system comprising; a cleaning vessel which is filled with a cleaning liquid and is designed to soak objects to be cleaned in its cleaning bath; an ultrasonic vibrator for radiating ultrasonic waves into the cleaning bath; an oscillator associated with said ultrasonic vibrator; and degassing means to remove gases from said cleaning liquid for activating the formation of cavitation in said cleaning bath at the time of radiating ultrasonic waves into said cleaning bath, said degassing means comprising a boiling vessel positioned on the side on which said cleaning liquid is supplied to said cleaning vessel, thereby removing from said cleaning liquid the gases whose boiling point is lower than the boiling point of said cleaning liquid, characterized in that the degassed cleaning liquid is supplied to said cleaning vessel to provide a high-temperature zone at the top level of said cleaning bath; and that said ultrasonic cleaning system further comprises: a collection vessel to collect the cleaning liquid when it overflows from said high-temperature zone of said cleaning bath, said collection vessel being connected by a circulation conduit to a low-temperature zone of said cleaning bath at the bottom level of said cleaning bath, thereby permitting the cleaning liquid to return to said cleaning vessel; a vapor vessel and a collection conduit to supply the cleaning liquid from said cleaning vessel to said vapor vessel, extending from an object-soaking position at an intermediate level between said high-temperature zone and said low-temperature zone in said cleaing bath.

2. Ultrasonic cleaning system according to claim 1 wherein said circulation conduit has a filter, a pump and cooling unit, said pump having an adjustment valve on its primary side.

3. Ultrasonic cleaning system according to claim 2 wherein said cleaning system further comprises a temperature controlling conduit between said pump and said adjustment valve, said temperature controlling conduit being equipped with a temperature control valve and being connected to said cleaning vessel at a level which is lower than the level at which said circulation conduit is connected to said cleaning vessel.

* * * * *